US009494154B2

(12) United States Patent
Fujisawa et al.

(10) Patent No.: US 9,494,154 B2
(45) Date of Patent: Nov. 15, 2016

(54) REFRIGERATOR

(75) Inventors: Ryo Fujisawa, Kobe (JP); Masatake Toshima, Kobe (JP); Toshikatsu Kanemura, Takasago (JP); Yoshihiro Nakayama, Takasago (JP); Koichiro Iizuka, Takasago (JP); Satoshi Ide, Takasago (JP); Kunihiko Suto, Chiyoda-ku (JP); Kazutaka Kurashige, Chiyoda-ku (JP); Ichirou Sakuraba, Nagoya (JP); Daisuke Hayashi, Nagoya (JP); Keiji Sugano, Amagasaki (JP); Shinji Shato, Amagasaki (JP); Hans Madsboll, Gregersensvej (DK); Klaus Damgaard Kristensen, Hojbjerg (DK)

(73) Assignees: Tokyo Electric Power Company, Incorporated, Tokyo (JP); Chubu Electric Power Company, Incorporated, Aichi (JP); THE KANSAI ELECTRIC POWER CO., INC., Osaka (JP); KABUSHI KAISHA KOBE SEIKO SHO, Hyogo (JP); DANISH TECHNOLOGICAL INSTITUTE, Taastrup (DK); JOHNSON CONTROLS DENMARK APS, Hojbjerg (DK)

( * ) Notice: Subject to any disclaimer, the term of this patent is extended or adjusted under 35 U.S.C. 154(b) by 523 days.

(21) Appl. No.: 13/635,386

(22) PCT Filed: Mar. 15, 2011

(86) PCT No.: PCT/JP2011/001511
§ 371 (c)(1),
(2), (4) Date: Sep. 14, 2012

(87) PCT Pub. No.: WO2011/114714
PCT Pub. Date: Sep. 22, 2011

(65) Prior Publication Data

US 2013/0014537 A1 Jan. 17, 2013

(30) Foreign Application Priority Data

Mar. 17, 2010 (JP) ..... 2010-060484

(51) Int. Cl.
*F04B 39/02* (2006.01)
*F25B 31/02* (2006.01)

(Continued)

(52) U.S. Cl.
CPC ..... *F04C 18/16* (2013.01); *F04C 23/001* (2013.01); *F04C 28/28* (2013.01); *F04C 29/028* (2013.01);

(Continued)

(58) Field of Classification Search
CPC ..... F04B 15/06; F04B 39/02; F04B 53/08; F16C 33/10; F16C 17/20; F25B 31/002; F25B 31/006; F25B 31/008
USPC ..... 62/468, 505, 193, 116; 417/13, 228, 417/438
See application file for complete search history.

(56) References Cited

U.S. PATENT DOCUMENTS 3,112,618 A * 12/1963 Weller ..... F25B 31/008 310/54
3,217,835 A * 11/1965 Settles ..... F16N 25/04 184/7.4

(Continued)

FOREIGN PATENT DOCUMENTS

JP 9-72619 A 3/1997
JP 9-268988 A 10/1997

(Continued)

OTHER PUBLICATIONS

The Extended Search Report from the European Patent Office in a corresponding European Application No. 11755905.4 dated Apr. 9, 2014.

(Continued)

*Primary Examiner* — Frantz Jules
*Assistant Examiner* — Erik Mendoza-Wilkenfe
(74) *Attorney, Agent, or Firm* — Studebaker & Brackett PC

(57) ABSTRACT

The refrigerator includes: a cooling-water line having a cooling-water pump to thereby send water for cooling a refrigerant inside of a condenser; a lubricating-water supply line connecting the part downstream from the cooling-water pump on the cooling-water line and a compressor 4 and supplying water flowing through the cooling-water line as a lubricant to the compressor 4; and a backup portion supplying water to the lubricating-water supply line instead of supplying water from the cooling-water line when the cooling-water pump is not driven.

7 Claims, 3 Drawing Sheets

(51) Int. Cl.

| | |
|---|---|
| ***F04C 18/16*** | (2006.01) |
| ***F04C 23/00*** | (2006.01) |
| ***F04C 28/28*** | (2006.01) |
| ***F04C 29/02*** | (2006.01) |
| ***F04C 29/04*** | (2006.01) |
| ***F25B 9/00*** | (2006.01) |
| ***F25B 31/00*** | (2006.01) |
| *F04C 28/02* | (2006.01) |
| *F04C 28/06* | (2006.01) |
| *F25B 25/00* | (2006.01) |

(52) U.S. Cl.

CPC ..... *F04C 29/04* (2013.01); *F25B 9/002* (2013.01); *F25B 31/004* (2013.01); *F04C 28/02* (2013.01); *F04C 28/06* (2013.01); *F25B 25/005* (2013.01); *F25B 2339/047* (2013.01); *F25B 2500/06* (2013.01); *F25B 2700/04* (2013.01)

(56) References Cited

U.S. PATENT DOCUMENTS

| | | | | |
|---|---|---|---|---|
| 3,250,082 | A * | 5/1966 | Klaben | F25B 31/002 184/6 |
| 3,276,218 | A | 10/1966 | Leonard et al. | |
| 3,330,335 | A * | 7/1967 | Leonard, Jr. | 165/62 |
| 7,387,189 | B2 * | 6/2008 | James | F01D 21/14 184/6.11 |
| 9,151,327 | B2 * | 10/2015 | Jenkins | F16C 17/24 |
| 2004/0154328 | A1 * | 8/2004 | Holtzapple et al. | 62/268 |
| 2007/0201999 | A1 | 8/2007 | Shibata et al. | |
| 2008/0260562 | A1 * | 10/2008 | Van Der Heggen et al. | 418/142 |
| 2011/0303491 | A1 * | 12/2011 | Jenkins | 184/7.4 |

FOREIGN PATENT DOCUMENTS

| | | | |
|---|---|---|---|
| JP | 2009-058165 | A | 3/2009 |
| JP | 200958165 | * | 3/2009 |
| WO | WO 2008/129921 | A1 | 10/2008 |
| WO | WO 2010/010925 | A1 | 1/2010 |

OTHER PUBLICATIONS

International Search Report, from the International Bureau; in corresponding International Application No. PCT/JP2011/001511, mailed Jun. 14, 2011, 1 page.

Notification of Transmittal of Translation of the International Preliminary Report on Patentability and the Written Opinion of the International Searching Authority issued from the International Bureau in the corresponding International Application No. PCT/JP2011/001511, mailed Nov. 1, 2012, and Jun. 14, 2011, 5 pages.

* cited by examiner

REFRIGERATOR

This application is the U.S. National Stage and claims the priority of International Application No. PCT/JP2011/001511, filed Mar. 15, 2011, which claims the priority from Japanese Patent Application No. 2010-060484, filed on Mar. 17, 2010, the content of which is hereby incorporated by reference into this application.

TECHNICAL FIELD

The present invention relates to a refrigerator.

BACKGROUND ART

Conventionally, a refrigerator for example as disclosed in Patent Document 1 includes an evaporator, a compressor and a condenser.

Such a refrigerator includes, for example, a compressor shown in FIG. 3 by Patent Document 2. This compressor is a two-stage screw compressor compressing a refrigerant gas such as a CFC gas in two stages and including a pair of first-stage screw rotors 101 and 102 and a pair of second-stage screw rotors 103 and 104, each screw rotor 101 to 104 being housed in a casing 106.

The first-stage screw rotors 101 and 102 engage with each other in a first compression chamber 106*a* inside of the casing 106 and the second-stage screw rotors 103 and 104 engage with each other in a second compression chamber 106*b* inside of the casing 106. The rotor shaft of each screw rotor 101 to 104 is supported by each corresponding bearing 108. In the first compression chamber 106*a*, the first-stage screw rotors 101 and 102 mutually engage and rotate to thereby compress a refrigerant gas in the first stage, the compressed refrigerant gas is leaded to the second compression chamber 106*b*, and the second-stage screw rotors 103 and 104 there mutually engage and rotate to thereby compress the refrigerant gas in the second stage. After compressed in the second stage, the refrigerant gas is discharged from the compressor.

Each bearing 108 is supplied with a lubricating oil, a part of the supplied lubricating oil is contained in a refrigerant gas and flows inside of the compressor, and is discharged together with the refrigerant gas from the compressor. The refrigerant gas and lubricating oil discharged together are sent to an oil separator 110 and separated there. The separated refrigerant gas is sent to a condenser, while the separated lubricating oil is cooled by an oil cooler 111 and returned to the compressor and supplied again to each bearing 108 after impurities contained therein are removed by an oil filter 112.

Patent Document 1: Japanese Patent Laid-Open Publication No. H9-72619

Patent Document 2: Japanese Patent Laid-Open Publication No. H9-268988

SUMMARY OF THE INVENTION

A refrigerator provided with the above compressor has a number of problems: the oil separator 110 separating the refrigerant gas and lubricating oil discharged together from the compressor is provided, thereby making the configuration of the compressor more complex; and CFC gases used as the refrigerant gas, if disposed of, may adversely affect the natural environment such as causing global warming.

It is an object of the present invention to provide a refrigerator which is capable of supplying a lubricant certainly to a compressor to thereby prevent damage to the compressor and easily disposing of the lubricant and which is environment-friendly and simply configured.

A refrigerator according to the present invention includes: a compressor for compressing water vapor as a refrigerant; a condenser for condensing a refrigerant compressed by the compressor; an evaporator for evaporating a liquid refrigerant condensed by the condenser; a cooling-water line including a cooling-water pump to thereby send water for cooling a refrigerant in the condenser; a lubricating-water supply line connecting a part downstream from the cooling-water pump on the cooling-water line and the compressor and for supplying water flowing through the cooling-water line as a lubricant to the compressor; and a backup means for supplying water to the lubricating-water supply line instead of supplying water from the cooling-water line when the cooling-water pump is not driven.

The refrigerator is environment-friendly and simply configured while securing a lubricant supply to the compressor.

EMBODIMENTS FOR CARRYING OUT THE INVENTION

Embodiments of the present invention will be below described with reference to the drawings.

First Embodiment

Figure 1:
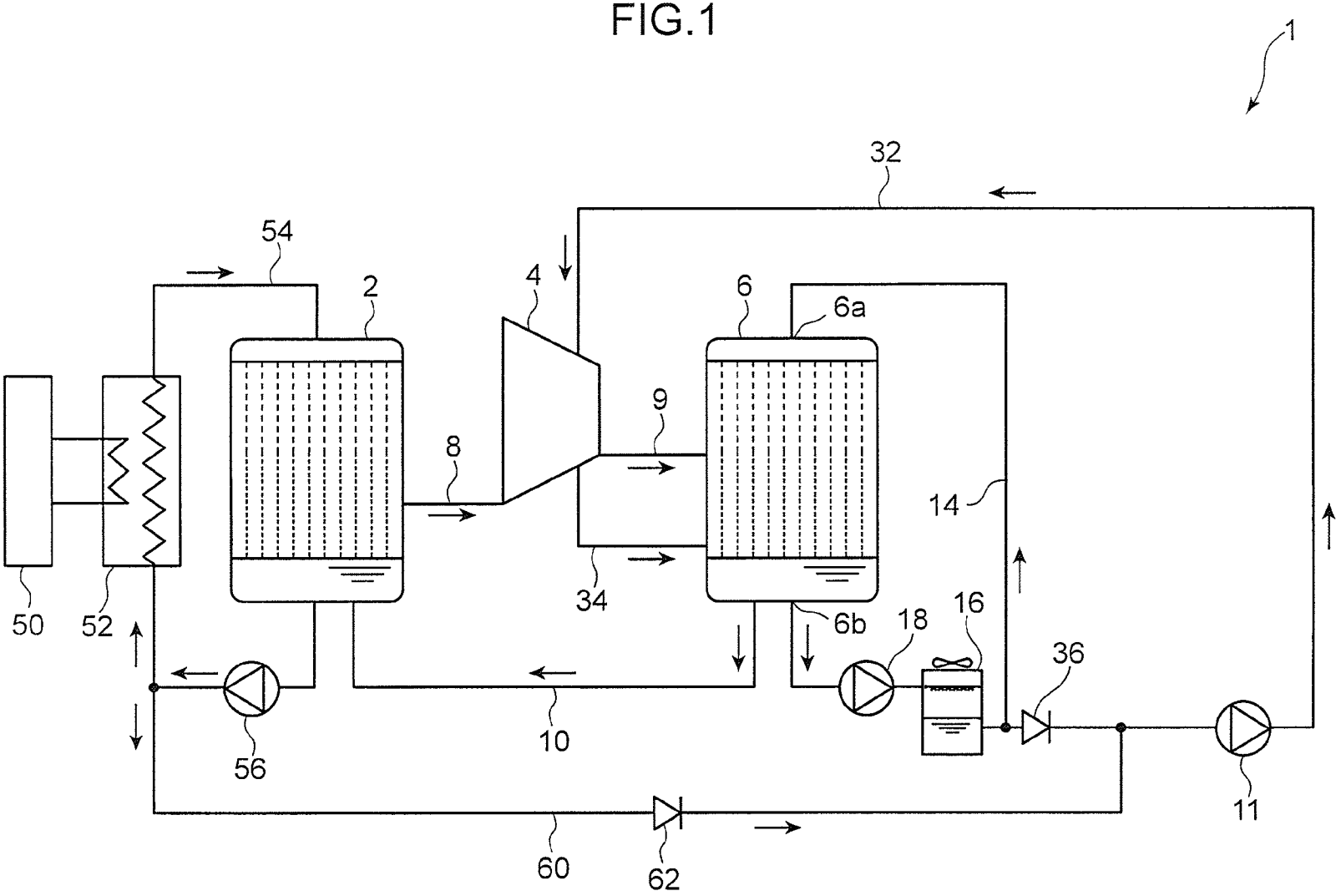
FIG. 1 is a block diagram showing a configuration of a refrigerator according to a first embodiment of the present invention.

FIG. 1 is a block diagram showing a configuration of a refrigerator 1 according to a first embodiment of the present invention. The refrigerator 1 is configured, for example, as a cooling apparatus such as an air conditioner, in which water is used as a refrigerant.

The refrigerator 1 includes a refrigerant circuit for circulating a refrigerant, a cooling circuit for circulating cooling water cooling the refrigerant, a utilization circuit for circulating water exchanging heat with the refrigerant, and a lubricating-water circuit for circulating lubricating water used as a lubricant for a compressor.

The refrigerant circuit includes an evaporator 2, a compressor 4, a condenser 6, a refrigerant-gas lead-in line 8, a refrigerant-gas lead-out line 9 and a refrigerant supply line 10.

The cooling circuit includes the condenser 6, a cooling-water line 14, a cooling tower 16 and a cooling-water pump 18.

The utilization circuit includes the evaporator 2, an indoor unit 50, an indoor circulation line 54 and a circulating pump 56.

The lubricating-water circuit includes the condenser 6, the cooling-water line 14, the cooling tower 16 and the cooling-water pump 18, as well as a lubricating-water pump 11, a lubricating-water supply line 32, the compressor 4 and a lubricating-water discharge line 34.

The compressor 4 compresses water vapor as a refrigerant gas evaporated in the evaporator 2. It includes a rotating shaft and a bearing supporting the rotating shaft (not shown), and a plurality of impellers (compression portion; not shown) attached to the rotating shaft, and compresses water vapor by rotating the impellers. The refrigerator 1 operates to thereby keep rotating the impellers and the rotating shaft until the refrigerator 1 stops normally or in an emergency because a failure or the like. The impellers and the rotating shaft are not supposed to stop immediately even if receiving a stop signal as the refrigerator 1 stops, and hence, they stop some time (e.g., minutes) after the stop signal.

The compressor 4 is connected through the refrigerant-gas lead-in line 8 to the evaporator 2 and connected through the refrigerant-gas lead-out line 9 to the condenser 6. In the compressor 4, water vapor sent through the refrigerant-gas lead-in line 8 from the evaporator 2 is compressed, and thereafter, sent through the refrigerant-gas lead-out line 9 to the condenser 6.

The condenser 6 cools water vapor as the refrigerant gas sent through the refrigerant-gas lead-out line 9 from the compressor 4 using cooling water to thereby condense the water vapor. It is a direct heat-exchange type—cooling and condensing water vapor as a refrigerant gas by bringing it into contact with cooling water. Water vapor as the refrigerant gas is cooled to condense and become condensed water.

The condenser 6 is connected through the refrigerant supply line 10 to the evaporator 2, and a part of the condensed water produced in the condenser 6 is sent as a liquid refrigerant (below called the water refrigerant) through the refrigerant supply line 10 to the evaporator 2. A pressure in the condenser 6 is higher than a pressure in the evaporator 2. Thus, a part of the condensed water in the condenser 6 flows into the evaporator 2. As described later, the remaining water of the condensed water is discharged as cooling water from a cooling-water outlet 6*b* to the cooling tower 16.

The evaporator 2 evaporates the water refrigerant sent from the condenser 6. The evaporator 2 cools water leaded from a heat exchanger 52 (described later) of the indoor unit 50 using vaporization heat of the water refrigerant. The evaporator 2 is a direct heat-exchange type—cooling water leaded from the heat exchanger 52 by bringing it into contact with the water refrigerant. The evaporator 2 generates water vapor by evaporation of the water refrigerant.

As described earlier, the evaporator 2 is connected through the refrigerant-gas lead-in line 8 to the compressor 4, and water vapor as a refrigerant gas evaporated in the evaporator 2 is sent through the refrigerant-gas lead-in line 8 to the compressor 4.

In this way, the refrigerator 1 includes the refrigerant circuit in which the water vapor are circulating as a refrigerant gas. The water vapor as a refrigerant gas is supplied from the compressor 4 through the refrigerant-gas lead-out line 9 to the condenser 6, and is condensed in the condenser 6 to become a water refrigerant. The water refrigerant is discharged from the condenser 6 to the evaporator 2 through the refrigerant supply line 10, and is vaporized in the evaporator 2 to become a water vapor as a refrigerant-gas. Water vapor as a refrigerant gas is returned through the refrigerant-gas lead-in line 8 to the compressor 4.

The indoor unit 50 is provided with the heat exchanger (utilization heat exchanger) 52 exchanging heat between water supplied from the evaporator 2 and indoor air to thereby cool the indoor air.

The heat exchanger 52 is connected through the indoor circulation line 54 to the evaporator 2 and supplied with water from the evaporator 2 through the indoor circulation line 54. Specifically, since the heat exchanger 52 is arranged downstream from the circulating pump 56, the circulating pump 56 pressurizes water discharged to the indoor circulation line 54 from the evaporator 2 and thereby supplies water to the heat exchanger 52, and the water supplied to the heat exchanger 52 exchanges heat with indoor air and then returns again to the evaporator 2 through the indoor circulation line 54.

In this way, the refrigerator 1 includes the utilization circuit for, by the circulating pump 56, supplying water from the evaporator 2 through the indoor circulation line 54 to the heat exchanger 52, exchanging heat with indoor air in the heat exchanger 52, and thereafter returning water discharged from the heat exchanger 52, to the evaporator 2 through the indoor circulation line 54.

The condenser 6 is provided with the cooling-water outlet 6*b* for discharging a part of water from the condenser 6 and a cooling-water inlet 6*a* for leading water into the condenser 6 which are connected through the cooling-water line 14.

The cooling-water line 14 is provided with the cooling tower 16 cooling, as cooling water, condensed water discharged through the cooling-water line 14 from the cooling-water outlet 6*b*. The cooling tower 16 is an open type—including, at an upper part thereof, an opening for leading outdoor air inside and a fan for sending outdoor air inside through the opening. The cooling tower 16 cools the condensed water to become cooling water sent inside through by showering the cooling water and blowing it using the fan. The thus cooled cooling water in the cooling tower 16 passes through the cooling-water line 14 and returns to the condenser 6 from the cooling-water inlet 6*a*. Specifically, the cooling-water pump 18 is arranged between the cooling tower 16 and the cooling-water inlet 6*a* and pressurizes water discharged from the cooling-water outlet 6*b* to thereby send the water to the cooling tower 16 and then the cooling-water inlet 6*a*.

In this way, the refrigerator 1 includes a cooling circuit for, by the cooling-water pump 18, sending water through the cooling-water line 14 and supplying it to the cooling tower 16 from the condenser 6, and thereafter, sending water discharged from the cooling tower 16 through the cooling-water line 14 and returning it to the condenser 6.

To the compressor 4 are connected the refrigerant-gas lead-in line 8 and the refrigerant-gas lead-out line 9, as well as the lubricating-water supply line 32 and the lubricating-water discharge line 34.

The lubricating-water supply line 32 supplies a bearing or the like of the compressor 4 with a lubricant. It connects the compressor 4 and the cooling-water line 14, and more specifically, connects the bearing or the like of the compressor 4 and the downstream part of the cooling tower 16 on the cooling-water line 14. A part of cooling water returning from the cooling tower 16 through the cooling-water line 14 to the condenser 6 is supplied as lubricating water to the compressor 4 through the lubricating-water supply line 32.

In the refrigerator 1, water easily disposed of is used as a lubricant for the compressor 4 and a part of cooling water supplied to the condenser 6 is also used as the lubricant, thereby simplifying the configuration of the refrigerator 1. Besides, water cooled in the cooling tower 16 is supplied to the bearing or the like of the compressor 4 and hence has a cooling effect on the bearing or the like.

The lubricating-water supply line 32 is provided with the lubricating-water pump 11 pressurizing water flowing through the lubricating-water supply line 32 and thereby sending it to the compressor 4. In this embodiment, the lubricating-water pump 11 further sends, to the compressor 4, a part of cooling water sent to the cooling tower 16 from the condenser 6 through the cooling-water line 14 by the discharge pressure of the cooling-water pump 18.

The lubricating-water discharge line 34 connects the compressor 4 and the condenser 6. Specifically, lubricating water discharged from the bearing or the like of the compressor 4 passes through the lubricating-water discharge line 34, is discharged to the condenser 6, and then, discharged together with cooling water to the cooling-water line 14 from the cooling-water outlet 6*b* of the condenser 6.

In this way, the refrigerator 1 includes the lubricating-water circuit for, by the cooling-water pump 18 and the lubricating-water pump 11, supplying water from the condenser 6 via the cooling tower 16 to the compressor 4 through the cooling-water line 14 and the lubricating-water supply line 32, and thereafter, sending water discharged from the compressor 4 through the lubricating-water discharge line 34 and returning it to the condenser 6. The lubricating-water circuit supplies lubricating water to the compressor 4, thereby evading damage such as a seizure or the like in the compressor 4.

In the case where the lubricating-water circuit is the only path supplying lubricating water to the compressor 4, however, if the cooling-water pump 18 stops in an emergency because of a failure or the like, no water is supplied from the condenser 6 to the lubricating-water supply line 32 to thereby stop supplying lubricating water to the compressor 4. As described earlier, it takes some time for the compressor 4 to actually stop after receiving a stop command, and thereby, in the case of the lubricating-water circuit alone, if the cooling-water pump 18 stops in case of emergency, the compressor 4 may operate without lubricating water and thereby suffer damage.

Taking this into account, the refrigerator 1 includes an emergency path (backup means) for supplying water flowing through the indoor circulation line 54 to the compressor 4 when the cooling-water pump 18 is not driven and when a rotating shaft or the like of the compressor 4 is rotating. Water flowing through the indoor circulation line 54 is lead to the lubricating-water supply line 32 through the emergency lubricating-water supply line 60 and lead to the compressor 4 via the lubricating-water supply line 32. as via the emergency lubricating-water supply line 60 and the lubricating-water supply line 32.

The emergency lubricating-water supply line 60 connects the indoor circulation line 54 and the lubricating-water supply line 32. One end of the emergency lubricating-water supply line 60 is connected to an upstream part from the lubricating-water pump 11 on the lubricating-water supply line 32. The pressure of this connection part drops as the quantity of water in the cooling tower 16 decreases when the cooling-water pump 18 stops, thereby producing a differential pressure between both ends of the emergency lubricating-water supply line 60 or the indoor circulation line 54 side and the lubricating-water supply line 32 side on the emergency lubricating-water supply line 60, and leading water flowing through the indoor circulation line 54 to flow through the emergency lubricating-water supply line 60 toward the lubricating-water supply line 32. Simply using the differential pressure between the both ends of the emergency lubricating-water supply line 60, the refrigerator 1 can supply water to the lubricating-water supply line 32 even when the cooling-water pump 18 is not driven.

Particularly, in the refrigerator 1, the other end of the emergency lubricating-water supply line 60 is connected to a downstream part from the circulating pump 56 on the indoor circulation line 54. The circulating pump 56 is driven even if the cooling-water pump 18 stops in an emergency because of a failure or the like, and thereby, even if the cooling-water pump 18 stops, the other end of the emergency lubricating-water supply line 60 connected to the part downstream from the circulating pump 56 is pressurized by the circulating pump 56 and the pressure there is kept relatively high. Accordingly, when the cooling-water pump 18 stops, a relatively high differential pressure is produced between both ends of the emergency lubricating-water supply line 60, thereby sending water flowing through the indoor circulation line 54 smoothly to the lubricating-water supply line 32.

The emergency lubricating-water supply line 60 is provided with a check valve (regulation portion) 62 which permits water to flow from the indoor circulation line 54 side to the lubricating-water supply line 32 side on the emergency lubricating-water supply line 60 while preventing water from flowing in the opposite direction. Therefore, when the cooling-water pump 18 is driven, even if the pressure on the lubricating-water supply line 32 side becomes higher than the pressure on the indoor circulation line 54 side on the emergency lubricating-water supply line 60, the check valve 62 prevents the water from sending from the lubricating-water supply line 32 to the indoor circulation line 54, thereby supplying water flowing through the lubricating-water supply line 32 certainly to the compressor 4.

In this embodiment, the check valve 62 prevents water from flowing from the indoor circulation line 54 to the lubricating-water supply line 32 if the differential pressure of a pressure on the indoor circulation line 54 side with respect to a pressure on the lubricating-water supply line 32 side on the emergency lubricating-water supply line 60 is below a reference value. The reference value is a maximum differential-pressure value to be produced between the indoor circulation line 54 side and the lubricating-water supply line 32 side on the emergency lubricating-water supply line 60 when the cooling-water pump 18 is driven. Therefore, in the refrigerator 1, although the cooling-water pump 18 is not at a stop, even if the pressure on the indoor circulation line 54 side becomes higher than the pressure on the lubricating-water supply line 32 side on the emergency lubricating-water supply line 60, the check valve 62 prevents the differential pressure from sending water into the lubricating-water supply line 32 from the indoor circulation line 54.

Herein, for example, a control valve opening and closing the flow path of the emergency lubricating-water supply line 60 and a detecting means detecting a failure in the cooling-water pump 18 may be provided. If the detecting means detects a failure in the cooling-water pump 18, the control valve may open the flow path of the emergency lubricating-water supply line 60 to thereby supply water to the lubricating-water supply line 32. However, as described above, when the cooling-water pump 18 stops, a differential pressure is produced between the indoor circulation line 54 side and the lubricating-water supply line 32 side on the emergency lubricating-water supply line 60, thereby supplying water to the lubricating-water supply line 32, though no such detecting means is provided. Therefore, the refrigerator 1 saves the detecting means or the control valve and hence has a simple configuration.

On the lubricating-water supply line 32, a check valve (back-flow regulation portion) 36 is provided upstream from the connection part thereof to the emergency lubricating-water supply line 60. The check valve 36 prevents water from flowing upstream from downstream part on the lubricating-water supply line 32, in other words, flowing to the cooling-water line 14. The regulation of the check valve 36 makes it possible to supply water flowing through the emergency lubricating-water supply line 60 into the lubricating-water supply line 32, certainly to the compressor 4, without leading the water into the cooling-water line 14.

In this way, in the refrigerator 1, when the cooling-water pump 18 is driven, the cooling-water pump 18 and the lubricating-water pump 11 lead a part of cooling water discharged from the condenser 6 to pass through the cooling-water line 14 and the lubricating-water supply line 32, and then, supply it to the compressor 4. On the other hand, when the cooling-water pump 18 is not driven, the lubricating-water pump 11 leads water in the evaporator 2 to pass through the indoor circulation line 54, the emergency lubricating-water supply line 60 and the lubricating-water supply line 32, and then, supplies it to the compressor 4. The lubricating-water pump 11 is constantly driven while a rotating shaft or the like of the compressor 4 is rotating, and for example, the lubricating-water pump 11 is controlled based on a rotation signal detected by a rotational-speed sensor attached to the compressor 4 and keeps being driven while the rotation signal is detected.

A line may be provided for the lubricating-water pump 11 stopped. The line is connected the emergency lubricating-water supply line 60 to the part downstream from the lubricating-water pump 11 on the lubricating-water supply line 32. In this case, the line connected the emergency lubricating-water supply line 60 to the part downstream from the lubricating-water pump 11 on the lubricating-water supply line 32 is preferably provided with a check valve which prevents water from flowing from the part of the lubricating-water supply line 32 downstream from the lubricating-water pump 11 to the emergency lubricating-water supply line 60 during the lubricating-water pump 11 driving.

As described so far, in the refrigerator 1 according to the first embodiment, water is used as a refrigerant gas, thereby if the refrigerant gas is disposed of, affecting the natural environment far less than if a chemical substance such as a chlorofluorocarbon gas is used as a refrigerant. Besides, water is used as a lubricant for the compressor 4, and thereby, the water as the lubricant can be disposed of directly without any complicated disposal. Further, even if lubricating water supplied to the compressor 4 mixes with water vapor as a refrigerant gas in the compressor 4, then because both are water, there is no need to separate the lubricating water from the refrigerant gas. Therefore, different from a conventional one allowing an oil separator to separate a refrigerant gas and a lubricating oil discharged together from a compressor, no separator separating a refrigerant gas and a lubricating water is needed, thereby simplifying the configuration of the refrigerator 1. In sum, the refrigerator 1 can be said to be environment-friendly and simply configured. Further, in the refrigerator 1, using a discharge pressure of the cooling-water pump 18, a part of cooling water for cooling the refrigerant inside of the condenser 6 is supplied as a lubricant to the compressor 4, and thereby, the water as the lubricant can be smoothly supplied to the compressor 4 without any separate path for supplying it to the compressor 4.

Furthermore, in the refrigerator 1, even when the cooling-water pump 18 is not driven, water is supplied from the evaporator 2 through the emergency lubricating-water supply line 60 to the lubricating-water supply line 32, and thereby, water as a lubricant is supplied to the compressor 4 even in case of a failure or the like in the cooling-water pump 18, so that a seizure or the like can be prevented in the compressor 4. Besides, the refrigerator 1 can be more simply configured and smaller than a refrigerator including a storage tank 260 (described later) according to a second embodiment of the present invention.

Moreover, in the refrigerator 1, the emergency lubricating-water supply line 60 is connected to the part downstream from the circulating pump 56 on the indoor circulation line 54, and thereby, the circulating pump 56 heightens the pressure on the indoor circulation line 54 side on the emergency lubricating-water supply line 60 to thereby produce a differential pressure between it and the pressure on the lubricating-water supply line 32 side on the emergency lubricating-water supply line 60, so that water in the indoor circulation line 54 can be supplied through the emergency lubricating-water supply line 60 smoothly to the lubricating-water supply line 32.

In addition, the check valve 62 prevents water from flowing from the lubricating-water supply line 32 through the emergency lubricating-water supply line 60 toward the indoor circulation line 54, thereby preventing water flowing through the lubricating-water supply line 32 from branching to the emergency lubricating-water supply line 60 to reduce the water supplied to the compressor 4. Only if the pressure on the indoor circulation line 54 side or the evaporator 2 side on the emergency lubricating-water supply line 60 is higher by the reference value or above than the pressure on the lubricating-water supply line 32 side thereon, the check valve 62 permits water to flow from the indoor circulation line 54 to the lubricating-water supply line 32. Accordingly, although the cooling-water pump 18 is not at a stop, water is prevented from flowing into the lubricating-water supply line 32 from the indoor circulation line 54, thereby securing water flowing through the indoor circulation line 54. Further, the check valve 36 prevents water from flowing from the lubricating-water supply line 32 reversely toward the cooling-water line 14, thereby leading water supplied from the indoor circulation line 54 through the emergency lubricating-water supply line 60 certainly to the compressor 4.

Second Embodiment

Figure 2:
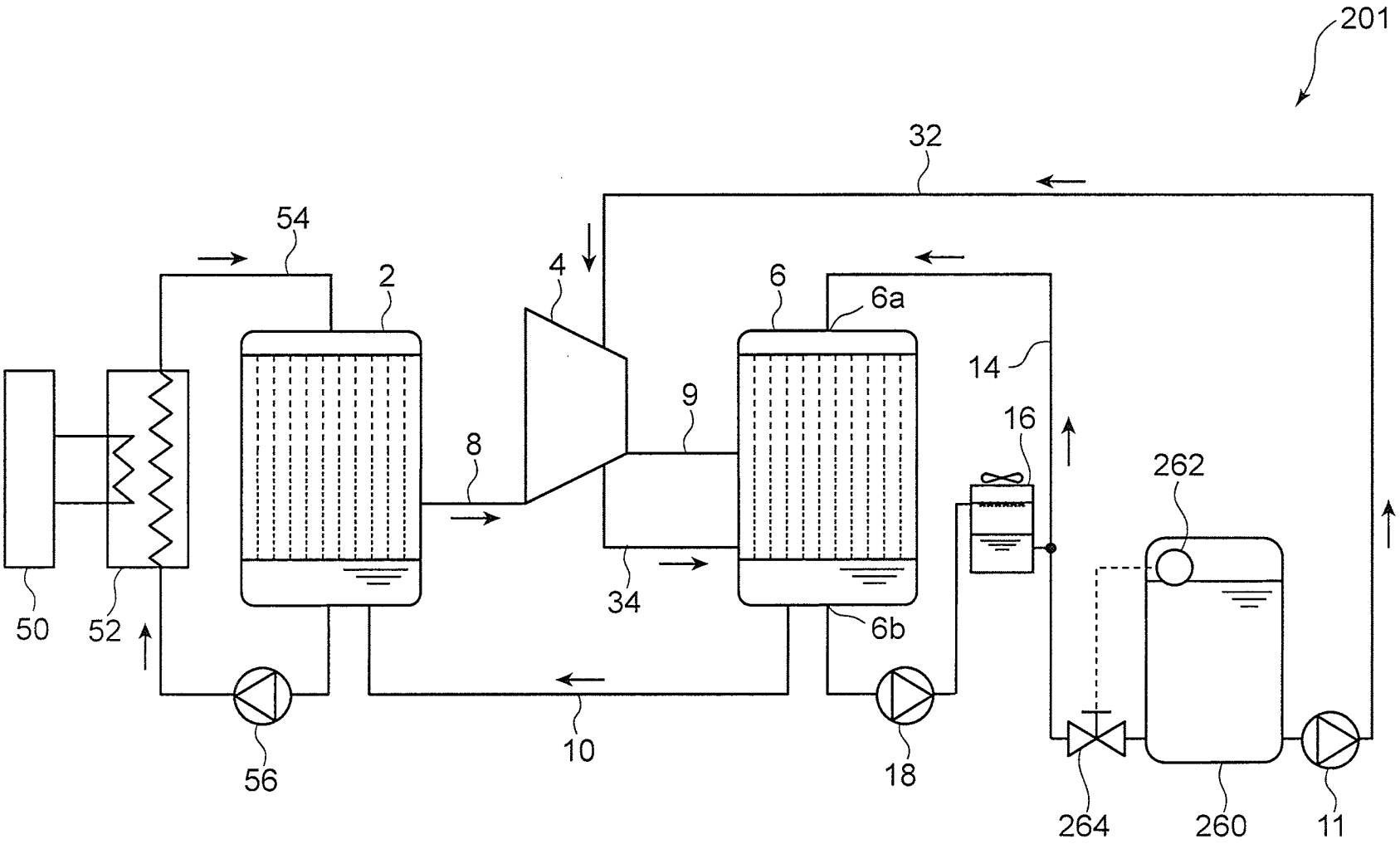
FIG. 2 is a block diagram showing a configuration of a refrigerator according to a second embodiment of the present invention.
Figure 3:
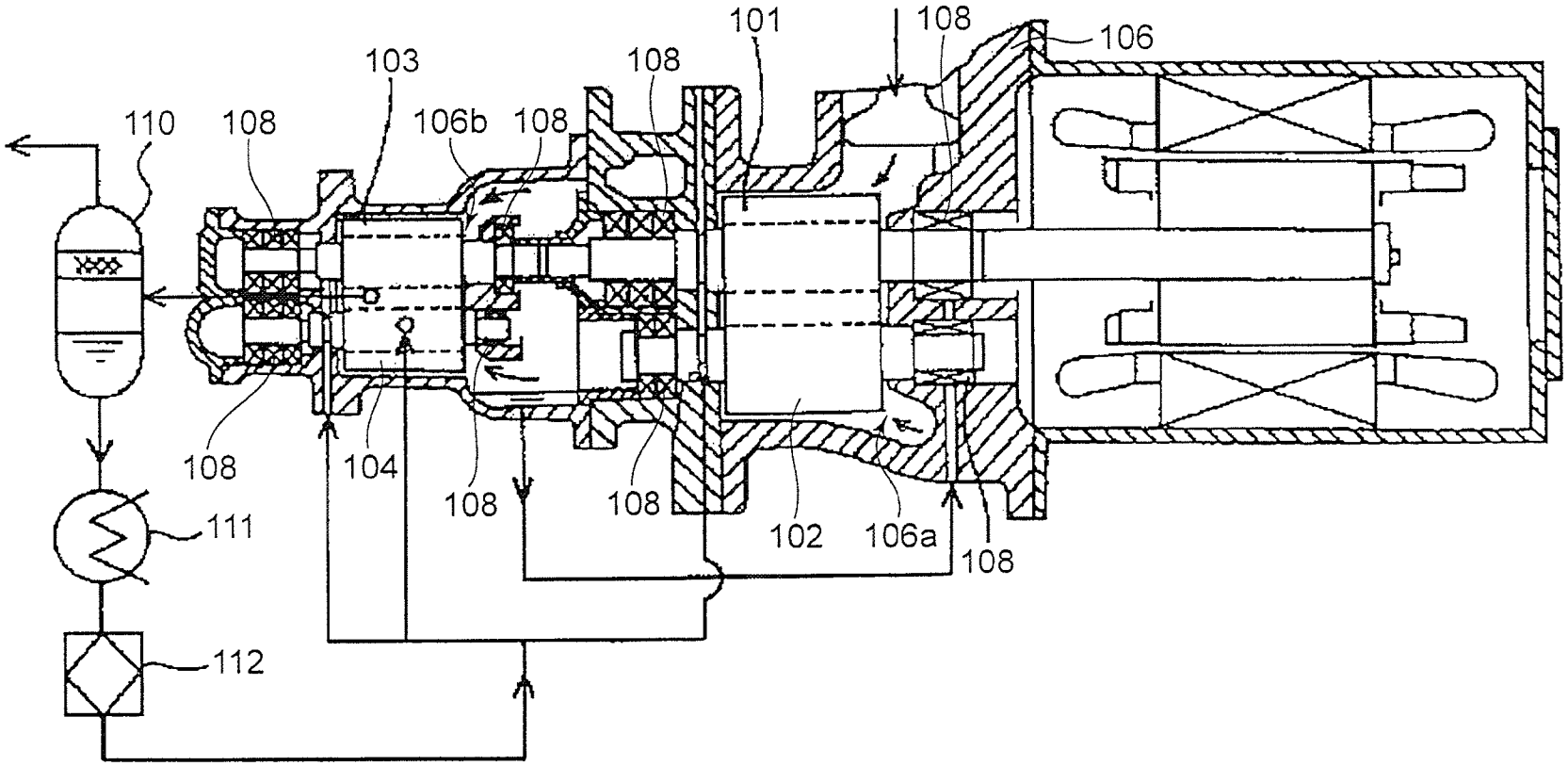
FIG. 3 is a schematic sectional view showing a configuration of a compressor according to a prior art.

FIG. 2 is a block diagram showing a configuration of a refrigerator 201 according to a second embodiment of the present invention. In the second embodiment, the emergency lubricating-water supply line 60 is replaced with the storage tank 260 arranged on the lubricating-water supply line 32. Water stored in the storage tank 260 is supplied to the lubricating-water supply line 32, and when the cooling-water pump 18 is not driven, water is supplied to the compressor 4 through the lubricating-water supply line 32.

Since the storage tank 260 is arranged midway on the lubricating-water supply line 32, cooling water branching from the cooling-water line 14 to the lubricating-water supply line 32 passes the storage tank 260 and reaches the compressor 4. The same lubricating-water pump 11 according to the first embodiment is provided downstream from the storage tank 260 on the lubricating-water supply line 32. The lubricating-water pump 11 supplies water stored in the storage tank 260 to the compressor 4.

The storage tank 260 includes a water gauge (storage quantity detecting means) 262 detecting the level of water stored in the storage tank 260. Upstream from the storage tank 260 on the lubricating-water supply line 32, a control valve 264 is provided which regulates the quantity of water leaded into the storage tank 260.

The refrigerator 201 controls the opening of the control valve 264 according to the level of water stored in the storage tank 260 detected by the water gauge 262 in such a way that the water level falls to a reference value or under, and thereby keeping the quantity of the water stored in the storage tank 260 being equal or larger than the reference quantity. The reference quantity is equal to or larger than the quantity of lubricating water to be supplied to the compressor 4 until the compressor 4 actually stops after receiving a stop command which is necessary for preventing the compressor 4 from suffering damage. In the refrigerator 201, therefore, even if the cooling-water pump 18 stops in an emergency because of a failure or the like and no water is supplied to the lubricating-water supply line 32 from the cooling-water line 14, then using the water stored in the storage tank 260, an adequate quantity of lubricating water can be supplied to the compressor 4.

In this way, the refrigerator 201 supplies lubricating water to the compressor 4 from the storage tank 260 when the cooling-water pump 18 is driven, and using the cooling-water pump 18, supplies a part of cooling water branching from the cooling-water line 14 to the storage tank 260 through the lubricating-water supply line 32. At this time, the control valve 264 regulates the quantity of water supplied to the storage tank 260 from the cooling-water line 14. Specifically, if the storage quantity in the storage tank 260 is smaller than the reference quantity, a larger quantity of cooling water than the quantity of lubricating water supplied to the compressor 4 from the storage tank 260 is supplied to the storage tank 260 from the cooling-water line 14; if the storage quantity in the storage tank 260 is equal to the reference quantity, the same quantity of cooling water as the quantity of lubricating water supplied to the compressor 4 from the storage tank 260 is supplied to the storage tank 260 from the cooling-water line 14; and if the storage quantity in the storage tank 260 is larger than the reference quantity, the supply of cooling water to the storage tank 260 from the cooling-water line 14 comes to a stop.

On the other hand, when the cooling-water pump 18 is not driven, without supplying cooling water to the storage tank 260, lubricating water is supplied to the compressor 4 from the storage tank 260.

The configurations and operation other than the above according to the second embodiment are the same as those according to the first embodiment.

As described so far, the refrigerator 201 according to the second embodiment does not have complicating water path and thereby having simple configuration. In the refrigerator 201, the storage tank 260 is arranged on the lubricating-water supply line 32 and water in the lubricating-water supply line 32 is supplied to the storage tank 260, and thereby no need to separately have water source for supplying water to the storage tank 260. The refrigerator 201 is capable of supplying lubricating water to the compressor 4 even when the cooling-water pump 18 is not driven. When the cooling-water pump 18 is not driven, water may flow from the storage tank 260 to the cooling tower 16. The control valve 264 may have a function as a check valve which prevents water from flowing from the storage tank 260 to the cooling tower 16, or the cooling tower 16 may be placed at higher position than the storage tank 260 to prevent water from flowing from the storage tank 260 to the cooling tower 16. Furthermore, the refrigerator 201 controls the opening of the control valve 264 according to a detection result in the water gauge 262 and regulates the quantity of water supplied to the storage tank 260, thereby securing the quantity of lubricating water necessary for preventing the compressor 4 from breaking down. Besides, too much water can be prevented from branching to the storage tank 260 from the cooling-water line 14, thereby suppressing a reduction in the quantity of cooling water supplied to the condenser 6 through the cooling-water line 14.

The embodiments disclosed at present should be considered illustrative and not restrictive in all respects. The scope of the invention is defined by the appended claims rather than by the description preceding them, and all changes that fall within metes and bounds of the claims, or equivalence of such metes and bounds are therefore intended to be embraced by the claims.

For example, in the first embodiment, instead of the cooling circuit formed by the cooling-water line 14, a water source may be separately provided, and from there, the cooling-water pump 18 can supply water to the condenser 6 and the lubricating-water supply line 32.

Moreover, in the first embodiment, it may be appreciated that the emergency lubricating-water supply line 60 is connected not to the indoor circulation line 54 but directly to the evaporator 2.

In addition, in the first embodiment, for example, it may be appreciated that the check valve 62 is omitted if the pressure on the indoor circulation line 54 side on the emergency lubricating-water supply line 60 is kept equal to the pressure on the lubricating-water supply line 32 side thereon when the cooling-water pump 18 is driven and if the pressure on the indoor circulation line 54 side on the emergency lubricating-water supply line 60 is higher than the pressure on the lubricating-water supply line 32 side thereon when the cooling-water pump 18 is not driven. In this case, no water flows through the emergency lubricating-water supply line 60 when the cooling-water pump 18 is driven and no water flows from the lubricating-water supply line 32 to the indoor circulation line 54 through the emergency lubricating-water supply line 60 when the cooling-water pump 18 is not driven, thereby making it possible to save the check valve 62.

Furthermore, in the second embodiment alike, instead of the cooling circuit formed by the cooling-water line 14, a water source may be separately provided, and from there, the cooling-water pump 18 may supply water to the condenser 6.

Moreover, in the second embodiment, instead of supplying cooling water from the cooling-water line 14 to the storage tank 260, water may be supplied to the storage tank 260 from a separate water source.

In addition, in the second embodiment, it may be appreciated that the water gauge 262 and the control valve 264 are omitted.

Furthermore, in the first or second embodiment, it may be appreciated that the heat exchanger 52 is omitted, and the indoor circulation line 54 is connected directly to the indoor unit 50 as an object to be cooled. In this case this object is directly cooled by the water sent from the evaporator 2 through the indoor circulation line 54.

In the first or second embodiment, alternatively, the cooling tower 16 may be a closed-type cooling tower which cools cooling water without bringing it into contact with outdoor air inside thereof, thereby preventing cooling water inside of the cooling tower 16 from getting mixed with foreign matter from outside.

Moreover, in the first or second embodiment, it may be appreciated that the compressor 4 is a compressor including a screw rotor or of another type.

In addition, in the first or second embodiment, the refrigerator 1, 201 may be applied to a cooling apparatus of every type other than an air conditioner.

A refrigerator according to the present invention includes: a compressor for compressing water vapor as a refrigerant;

a condenser for condensing a refrigerant compressed by the compressor; an evaporator for evaporating a liquid refrigerant condensed by the condenser; a cooling-water line including a cooling-water pump to thereby send water for cooling a refrigerant in the condenser; a lubricating-water supply line connecting a part downstream from the cooling-water pump on the cooling-water line and the compressor and for supplying water flowing through the cooling-water line as a lubricant to the compressor; and a backup means for supplying water to the lubricating-water supply line instead of supplying water from the cooling-water line when the cooling-water pump is not driven.

In the refrigerator, water is used as a refrigerant and a compressor lubricant, thereby if disposed of, affecting the natural environment less than if a chemical substance such as a CFC gas is used as the refrigerant and oil is used as the lubricant. Besides, there is no need to separate the lubricant and the refrigerant discharged from the compressor, thereby saving a separator. Further, using a discharge pressure of the cooling-water pump, a part of cooling water for cooling the refrigerant inside of the condenser is supplied as a lubricant to the compressor, and thereby, the water as the lubricant can be supplied to the compressor without any separate path for supplying it to the compressor. Still further, the refrigerator includes the backup means operating when the cooling-water pump is not driven. Even if any failure or the like occurs to the cooling-water pump, the water as the lubricant can be supplied to the compressor, thereby simplifying the configuration of the refrigerator and evading a failure in the compressor more certainly.

In the above refrigerator, preferably, the backup means may include an emergency lubricating-water supply line for supplying water in the evaporator to the lubricating-water supply line. According to this configuration, water in the evaporator can also be used as a lubricant, thereby saving a separate water source for supplying water to the lubricating-water supply line to simplify the configuration of the refrigerator.

In this case, it is preferable that the refrigerator further includes a utilization circuit having a circulating pump to thereby circulate water through the evaporator and a utilization heat exchanger, in which the emergency lubricating-water supply line connects the part downstream from the circulating pump on the utilization circuit and the lubricating-water supply line. According to this configuration, the emergency lubricating-water supply line is connected to the part downstream from the circulating pump, and thereby, using a discharge pressure of the circulating pump, water in the evaporator can be smoothly supplied to the lubricating-water supply line.

Furthermore, preferably, the backup means may include a regulation portion for permitting water to flow through the emergency lubricating-water supply line from the evaporator to the lubricating-water supply line while preventing water from flowing through the emergency lubricating-water supply line from the lubricating-water supply line to the evaporator. According to this configuration, when the cooling-water pump is driven or at another such time, water flowing through the lubricating-water supply line can be prevented from flowing into the evaporator through the emergency lubricating-water supply line, thereby supplying water flowing through the lubricating-water supply line certainly to the compressor.

Moreover, it is preferable that: in the emergency lubricating-water supply line, the differential pressure of a pressure on the evaporator side when the cooling-water pump is driven with respect to a pressure on the lubricating-water supply line side when the cooling-water pump is driven is set below a predetermined value; and if the differential pressure is below the predetermined value, the regulation portion prevents water in the emergency lubricating-water supply line from flowing from the evaporator side to the lubricating-water supply line side. According to this configuration, when the cooling-water pump is driven, a differential pressure is produced between a part on the lubricating-water supply line side and a part on the evaporator side in the emergency lubricating-water supply line, and thereby, water in the evaporator can be prevented from flowing into the lubricating-water supply line through the emergency lubricating-water supply line.

In the refrigerator, preferably, the lubricating-water supply line may be provided with a back-flow regulation portion for preventing water supplied from the emergency lubricating-water supply line from being leaded to the cooling-water line. According to this configuration, water supplied from the emergency lubricating-water supply line to the lubricating-water supply line can be prevented from flowing into the cooling-water line, thereby supplying water sent from the emergency lubricating-water supply line certainly to the compressor.

In addition, the backup means may include a storage tank storing water and supplying the stored water to the lubricating-water supply line. According to this configuration, when the cooling-water pump is not driven, water stored in the storage tank can be supplied to the lubricating-water supply line and further to the compressor, thereby evading a failure in the compressor without complicating the water path.

In this case, preferably, the storage tank may be connected to the cooling-water line and supplied with water from the cooling-water line. According to this configuration, there is no need to provide a separate water source for supplying the storage tank with water, thereby simplifying the configuration.

Furthermore, it is preferable that: the backup means includes a storage quantity detecting means for detecting a stored-water quantity in the storage tank and a regulating means for regulating a water quantity supplied to the storage tank; and the regulating means supplies water to the storage tank according to the stored-water quantity detected by the storage-quantity detecting means. This configuration enables the storage tank to secure lubricating water in a quantity large enough to evade a failure in the compressor.

The invention claimed is:

1. A refrigerator, comprising:

a compressor including a compression portion, a rotating shaft attached to the compression portion, and a bearing axially supporting the rotating shaft, for compressing water vapor as a refrigerant by the rotating of the rotating shaft;

a condenser for condensing a refrigerant compressed by the compressor;

an evaporator for evaporating a liquid refrigerant condensed by the condenser;

a cooling-water line including a cooling-water pump to thereby send water for cooling a refrigerant in the condenser;

a lubricating-water supply line supplying water from the cooling-water line to the compressor as a lubricant for the bearing of the compressor, the lubricating-water supply line connecting a part downstream from the cooling-water pump on the cooling-water line and the compressor; and a backup portion for supplying water to the lubricating-water supply line instead of supplying water from the cooling-water line when the cooling-water pump is not driven; wherein the backup portion includes an emergency lubricating-water supply line for supplying water in the evaporator to the lubricating-water supply line.

2. The refrigerator according to claim 1, further comprising a utilization circuit including a circulating pump to thereby circulate water through the evaporator and a utilization heat exchanger, wherein the emergency lubricating-water supply line connects a part downstream from the circulating pump on the utilization circuit and the lubricating-water supply line.

3. The refrigerator according to claim 1, wherein the backup portion includes a regulation portion for permitting water to flow through the emergency lubricating-water supply line from the evaporator to the lubricating-water supply line while preventing water from flowing through the emergency lubricating-water supply line from the lubricating-water supply line to the evaporator.

4. A refrigerator, comprising:

a compressor for compressing water vapor as a refrigerant;

a condenser for condensing a refrigerant compressed by the compressor;

an evaporator for evaporating a liquid refrigerant condensed by the condenser;

a cooling-water line including a cooling-water pump to thereby send water for cooling a refrigerant in the condenser;

a lubricating-water supply line supplying water from the cooling-water line to the compressor as a lubricant for a bearing of the compressor, the lubricating-water supply line connecting a part downstream from the cooling-water pump on the cooling-water line and the compressor; and a backup portion for supplying water to the lubricating-water supply line instead of supplying water from the cooling-water line when the cooling-water pump is not driven, wherein the backup portion includes:

an emergency lubricating-water supply line for supplying water in the evaporator to the lubricating-water supply line;

a regulation portion for permitting water to flow through the emergency lubricating-water supply line from the evaporator to the lubricating-water supply line while preventing water from flowing through the emergency lubricating-water supply line from the lubricating-water supply line to the evaporator;

wherein, in the emergency lubricating-water supply line, the differential pressure of a pressure on the evaporator side when the cooling-water pump is driven with respect to a pressure on the lubricating-water supply line side when the cooling-water pump is driven is set below a predetermined value; and if the differential pressure is below the predetermined value, the regulation portion prevents water from flowing from the evaporator side to the lubricating-water supply line side.

5. The refrigerator according to claim 1, wherein the lubricating-water supply line is provided with a back-flow regulation portion for preventing water supplied from the emergency lubricating-water supply line from being leaded to the cooling-water line.

6. A refrigerator, comprising:

a compressor including a compression portion, a rotating shaft attached to the compression portion, and a bearing axially supporting the rotating shaft, for compressing water vapor as a refrigerant by the rotating of the rotating shaft;

a condenser for condensing a refrigerant compressed by the compressor;

an evaporator for evaporating a liquid refrigerant condensed by the condenser;

a cooling-water line including a cooling-water pump to thereby send water for cooling a refrigerant in the condenser;

a lubricating-water supply line supplying water from the cooling-water line to the compressor as a lubricant for the bearing of the compressor, the lubricating-water supply line connecting a part downstream from the cooling-water pump on the cooling-water line and the compressor; and a backup portion for supplying water to the lubricating-water supply line instead of supplying water from the cooling-water line when the cooling-water pump is not driven; wherein the backup portion includes a storage tank arranged on the lubricating-water supply line for storing water and supplying the stored water to the lubricating-water supply line, a storage quantity detecting portion for detecting a stored-water quantity in the storage tank and a regulating portion for regulating a water quantity supplied to the storage tank; and the regulating portion supplies a water quantity to the storage tank in such a way that the stored-water quantity in the storage tank detected by the storage quantity detecting portion is equal to or larger than the quantity of the lubricant to be supplied to the compressor until the compressor actually stops after receiving a stop command.

7. The refrigerator according to claim 6, wherein the storage tank is connected to the cooling-water line and supplied with water from the cooling-water line.

* * * * *